US005188161A

United States Patent [19]

Erber

[11] Patent Number: 5,188,161

[45] Date of Patent: Feb. 23, 1993

[54] LOUVERABLE ROLLING SHUTTER

[76] Inventor: Gunther Erber, Feldgasse 31, A-9065 Ebental (Karnten), Austria

[21] Appl. No.: 719,914

[22] Filed: Jun. 24, 1991

[51] Int. Cl.[5] ..... E06B 9/08

[52] U.S. Cl. ..... 160/133; 49/90 PH

[58] Field of Search ..... 160/133, 169, 170, 174, 160/176.1, 34, 35, 36, 235, 236; 49/90 PH, 82, 74

[56] References Cited

U.S. PATENT DOCUMENTS 2,237,800 4/1941 Webber ..... 160/218 X
2,912,048 11/1959 Grau ..... 160/133
4,715,421 12/1987 Erber ..... 160/133

FOREIGN PATENT DOCUMENTS 0189091 7/1986 European Pat. Off. .
0330192 8/1989 European Pat. Off. .
2514121 10/1975 Fed. Rep. of Germany .
2834268 2/1980 Fed. Rep. of Germany .
2553467 4/1985 France .

*Primary Examiner*—Blair M. Johnson
*Attorney, Agent, or Firm*—Young & Thompson

[57] ABSTRACT

A louverable rolling shutter with a number of louverable, leaf-like shutter slats (1) articulated at their upper zones to pull chain links (2) and at their lower zones to adjusting chain links (5), and also being guided in fixed guide profiles (4) laterally by way of chain links. The guidance action is provided in the guide profiles (4) by the pull chain links (2) which latter are arranged in each case with the associated adjusting chain link (5) and louverable shutter slat (1) in side-by-side relationship and in alignment with respect to one another.

15 Claims, 5 Drawing Sheets

FIG. 5
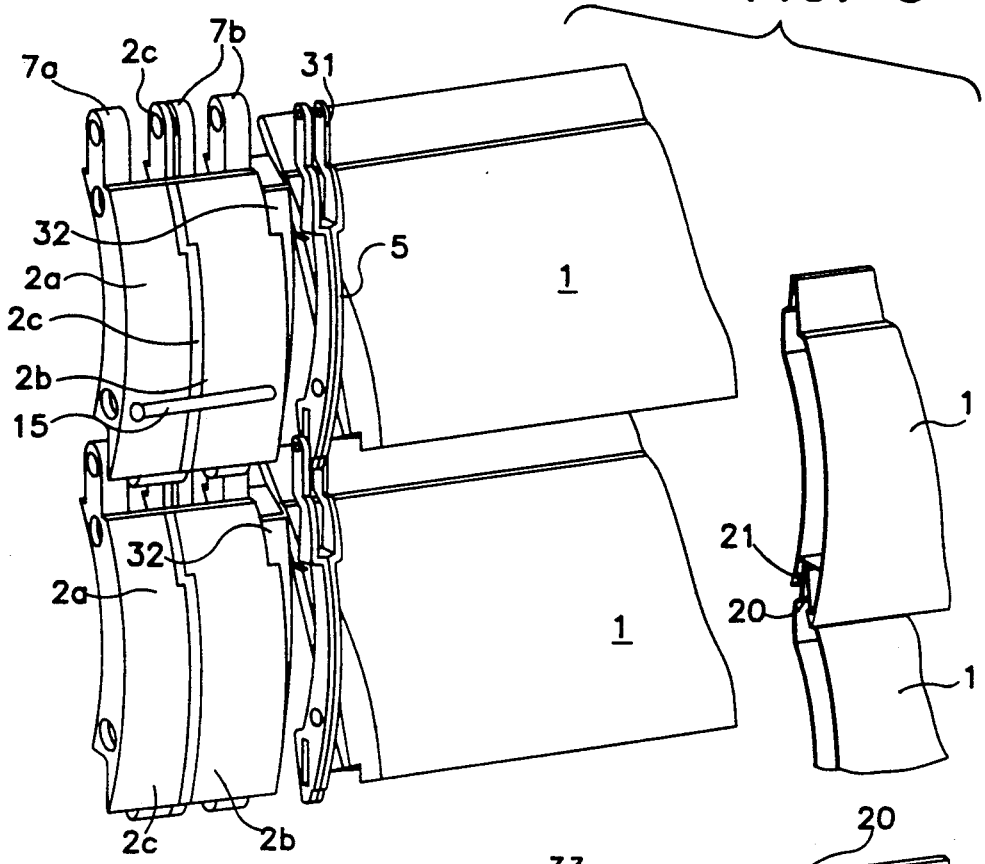
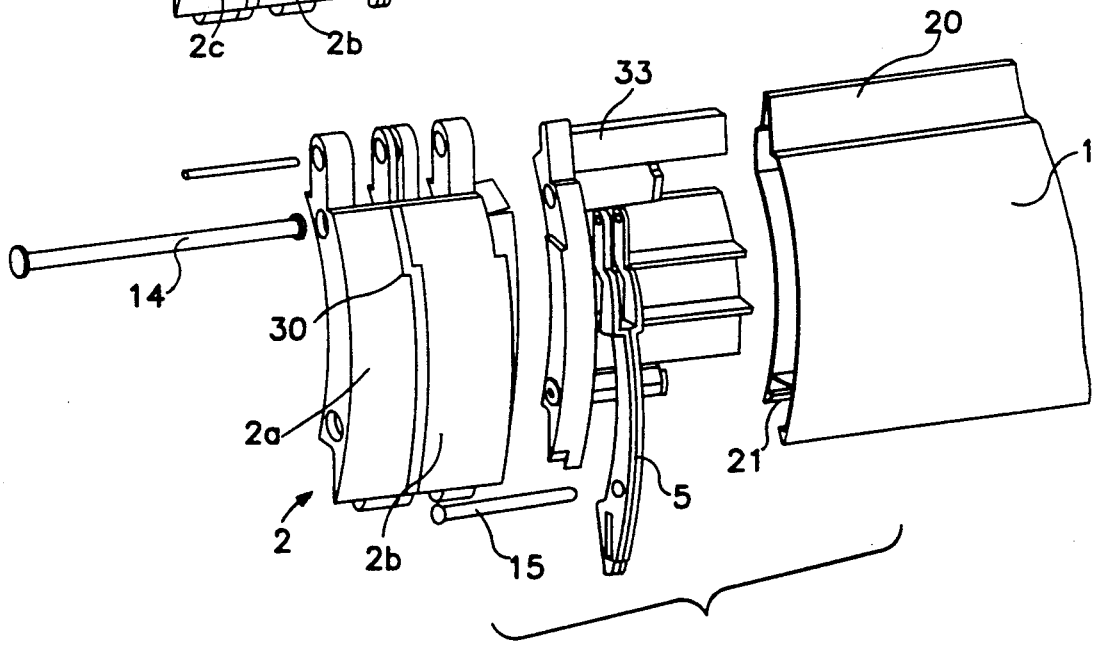
FIG. 6

LOUVERABLE ROLLING SHUTTER

FIELD OF THE INVENTION

The invention relates to a louverable rolling shutter of the type having a number of louverable, leaf-like shutter slats articualted by pull and adjusting chain links, and being constrained in fixed guide profiles laterally by chain links.

BACKGROUND OF THE INVENTION

In louverable rolling shutters, the individual shutter slats are articulated to pull and adjusting chain links so that the shutter slats can be pivoted from a rolling shutter position wherein the shutter slats fully shut off or cover the opening located therebehind, into a louvered position wherein light is able to penetrate between the thus-pivoted shutter slats. On account of the louver-adjusting device required for pivoting these shutter slats, special guide rails are needed in most cases for the installation of the rolling shutters. These guide rails must normally be wider than those of normal rolling shutters in order to be able to accommodate the louver device and/or parts thereof required for pivoting the shutter slats. As a consequence, retrofitting of normal rolling shutters already included in buildings with louverable rolling shutters is possible only with difficulties since the fixedly mounted frames and guide means must be replaced by those with larger dimensions. It is evident that it would be advantageous to design such louverable rolling shutters so that they can be installed in guide rails or guide profiles for normal rolling shutters without louvered design which are part of the original installation.

Louverable rolling shutters permitting such retrofitting of already present installations have been known (EP-A-0 189 091). In this arrangement, the louverable shutter slats are joined at their upper ends by pull chain links and at their lower ends by adjusting chain links. The pull chain links and the adjusting chain links are fashioned in this arrangement on one end in the manner of an eye and on the other end in the manner of a fork so that adjacent chain links can be composed in hinge-like manner. The shutter slats are received between respectively one pair of neighboring pull and adjusting chain links. This type of structure makes it inherently impossible to move the shutter slats into a closed tongue/groove position where the tongue provided in one shutter slat can be moved into a groove formed at the neighboring shutter slat for the production of a rolling shutter seal safe from breaking and entering.

Furthermore, the known louverable rolling shutter requires, besides the two chains of pull and adjusting chain links, another chain arranged along the edges at the shutter slats and made up of guide chain links guided in the fixedly installed guide profiles. The guide chain links are designed as slotted chain links and are joined hinge-like with one another by slotted bushings, i.e. bushings equipped with a longitudinal slot. The shutter slats are suspended by way of an articulated pin which latter is to be aligned axially with the slotted bushings of the guide chain links, which bushings must be designed correspondingly. In this arrangement, the slotted bushings must be designed, as connecting elements for the guide chain links, in such a way with regard to strength that they can withstand the stresses arising from the chain links disposed therebelow and from the shutter slats lying thereunder. Furthermore, the slotted bushings must be of such a structure that they can accommodate the hinge pins for the articulation of the shutter slats. Another function to be performed by these slotted bushings resides in that they must make it possible, during transition from the shuttered position into the louvered position, for the hinge pins to engage for the suspension of the shutter slats in the slots of the slotted chain links. Accordingly, the connection of the guide chain links must be designed in correspondence with the various functions; this is complicated and makes it difficult to accommodate guide chain links of such a design in already present guide rails for normal rolling shutters. Another drawback is to be seen in that the hinge sites for the articulation of the shutter slats to the guide chain links must be axially aligned with the axes of the slotted bushings, again resulting in structural limitations for the rolling shutter construction. Also, for transition from the shuttered position into the louvered position, corresponding stops must be provided at the shutter slats and at the guide chain links, as well as at a ventilating-position support to be specifically provided at the lowermost shutter slat. As seen in total, the conventional louverable rolling shutter is of a complicated structure, and operating failures cannot be excluded, either. Also, the coil circumference is comparatively large on account of the bulky adjusting and pull chain links attached to the front face as well as the rear face of the shutter slats. A further disadvantage resides in that the available see-through width for the zone that is louverable and/or available for looking therethrough is restricted on account of the three chains and the substantially strip-like design of the pull and adjusting chain links.

It is an object of the invention to provide a louverable rolling shutter which is of a simple and robust structure and also permits reliable louvered action. Furthermore, the rolling shutter is to be installable without difficulties in already present guide profiles for normal rolling shutters, and is to exhibit, upon winding, a coil diameter comparable to that of a normal rolling shutter.

This object has been attained in accordance with the invention by the features recited in the characterizing portion of claim 1, suitable further developments of the invention being characterized by the features-contained in the dependent claims.

SUMMARY OF THE INVENTION

According to the invention, the pull chain links and the adjusting chain links are arranged laterally at the two ends of each shutter slat, namely in side-by-side relationship as well as in mutual alignment so that the chain links represent practically a lateral extension of the shutter slats. Thereby, the shutter slats are not augmented on the front and rear sides by the thickness and/or bulk of the chain links, and this feature has a favorable effect on the coil diameter of the louverable rolling shutter. With the pull chain links and adjusting chain links being adapted in their cross-sectional dimension to the cross-sectional dimension of the shutter slat, and thus extending substantially flush with the front and rear faces of the shutter slats, practically the same coil diameter is obtained as in the case of a normal rolling shutter without louvered action design. On account of the lateral location of the chain links in alignment with the shutter slats, the shutter slats are not covered over by the chain links, permitting maximizing of the inside width of the louverable aperture zone. This optimizing feature is particularly prominent if at least the adjusting chain links are designed to be narrow in the manner of lamellae. Furthermore, the pull chain links can be utilized as guide elements for the shutter slats; as a result, a chain hoist is eliminated as compared with the conventional prior art. By means of this arrangement, the structural elements required for the louvered movement can furthermore be accommodated within the cross-sectional dimension of the shutter slats.

In the closed condition of the rolling shutter, with the chain links being adapted to the configuration of a shutter slat, a fully smooth and flush appearance of the rolling shutter protection face is achieved.

Due to the arrangement of the elements required for louvered action in alignment with the shutter slat, the louverable rolling shutter behaves, when being wound up, as if there were no louvered-action device at all. As a result, functional failures, i.e. unintended louvered position, are likewise excluded.

Another essential aspect of the invention resides furthermore in the uncoupling between the articulated chain links, on the one hand, and the joints required for the pivotal support of each shutter slat at the associated pull and adjusting chain links. As a consequence, the chain joints can be of a simple structure, and this holds also true for the joints for the accommodation of the shutter slats. Simple hinge pins can be utilized for the chains; these pins must carry, in the upper zone, the entire weight of the rolling shutter suspended therebelow. In contrast thereto, the hinge pins for supporting the shutter slats need merely absorb the weight of the individual shutter slat. Thereby, the louvered motion is likewise facilitated. Furthermore, a clean separation is attained between the chain joints and the louver joints which, in turn, prevents unintended triggering of the louver action. In particular, the articulation sites for attachment of the shutter slat to the chain links can be displaced from the vertical plane of the chain hinge pins whereby lever arms result which enhance the louver motion. In total, the design of the structural elements required for louvered action is simplified, and this has a favorable effect on the manufacture of the rolling shutter with louver action.

In this connection, it is advantageous to place the hinge pins into profiled moldings which can be inserted and which are arranged along the margin side of the shutter slats, so that the shutter slats can be designed and manufactured without regard to the louver motion.

In case the upper longitudinal rims of the shutter slats are designed as a tongue, i.e. as a projecting lobe, and the lower longitudinal rims are designed as a groove fashioned as a complement to the tongues, the shutter slats can be made to enter a tongue-and-groove position whereby security from break-ins is achieved. This movement into the tongue-and-groove position and out of this position can be absorbed and/or compensated for in a structurally simple way at the pull and adjusting chain links by an appropriate longitudinally displaceable guidance of the chain hinge pins.

Advantageously, the pull chain links are designed to be multipartite, especially bipartite, affording advantages from the viewpoint of manufacturing technology and permitting the incorporation of a reinforcing steel insert. The pull chain links can be designed to be hollow in this arrangement, for reasons of saving material; the cavity can optionally be filled with foam material.

Triggering of the louver motion can take place by means of varying mechanisms, but suitably a hook is formed at an adjusting chain link or a shutter slat or at an insert profile molding attached thereto; this hook cooperates with a counter hook for triggering the louver motion. Advantageously, the counter hook is arranged to be capable of deflection so that, for the normal rolling shutter function, the hook can be guided past the counter hook.

BRIEF DESCRIPTION OF THE DRAWINGS

Preferred embodiments of the invention will be described below with reference to the drawings wherein:

FIG. 5 is a perspective view of two shutter slats of an alternative embodiment wherein a detail on the right shows the profile of the shutter slats, FIG. 6 is an exploded perspective view of a shutter slat with associated louver elements.

DESCRIPTION OF THE PREFERRED EMBODIMENTS

Figure 1:
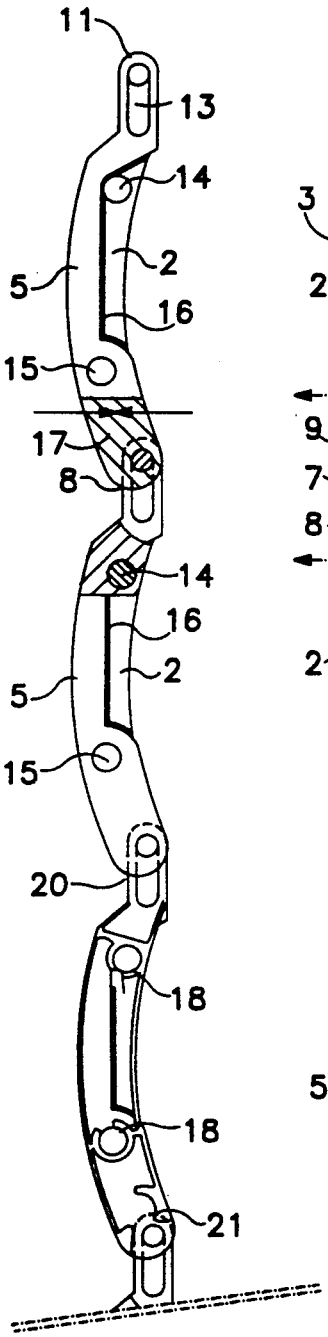
FIG. 1 is a sectional view of part of a preferred embodiment along line I—I in FIG. 2.
Figure 2:
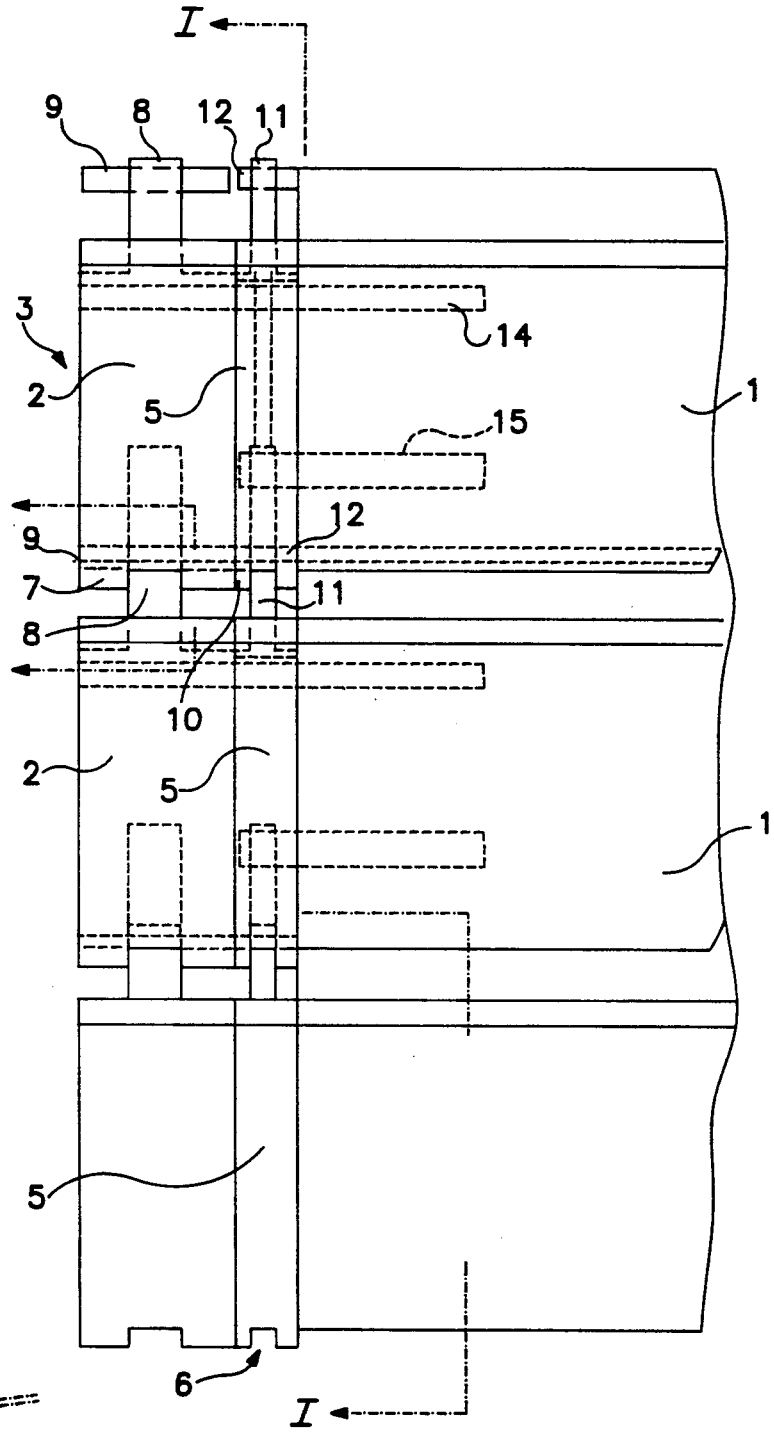
FIG. 2 is an end view of a preferred embodiment of a louverable rolling shutter, of which three shutter slats are illustrated.

In the embodiment according to FIGS. 1–4, each shutter slat 1 is associated with a pull chain link 2, joined to a pull chain 3. The rolling shutter and/or the shutter slats are guided in conventional U-shaped moldings 4 attached to the walls of the building in the zone of the opening to be closed up by the rolling shutter. For the louver-like adjustment of the shutter slats 1, adjusting chain links 5 are provided, of which respectively one link is associated with an end of a shutter slat 1, analogously to the pull chain links. The adjusting chain links 5 are joined together for the formation of an articulated adjusting chain 6.

It is obvious that the pull chain links 2 and also the adjusting chain links 5 are arranged in the respective chain hoist in vertical superimposed position. The pull chain links 2 and adjusting chain links 5, provided at the two ends of each shutter slat 1, are arranged in accordance with FIG. 2 in side-by-side relationship and, as can be seen from FIG. 1, 5 in alignment with regard to the corresponding shutter slat 1. This provides the advantage that the pull and adjusting chain links 2 and 5 do not add any bulk with their cross section or thickness to the shutter slat 1; accordingly, in this arrangement, there is no need to resort to the measure, frequently realized in the prior art, of saving space by the formation of recesses on the front and rear faces of the shutter slats 1, ensuing also in weakening of the shutter slat. Another advantage of this structure resides in that, when the rolling shutter is rolled up, the coil diameter is determined solely by the thickness of the shutter slats 1, i.e. the incorporation of a louver action device does not change anything as far as the coil circumference proper is concerned.

The pull chain links 2 are connected with one another in articulated fashion. In the illustrated embodiment, each pull chain link 2 exhibits at its lower end a fork 7 formed from two legs defining between them a recess, and a shackle 8 at the upper end, this shackle engaging between the bifurcate recess. Upon interlocking of the fork 7 and the shackle 8, with inclusion of a hinge pin 9, there is thus obtained a hinge-like joint between the pull chain links 2.

The articulated connection of the adjusting chain links 5 takes place likewise in an analogous fashion, the fork being denoted by 10, the shackle by 11, and the hinge pin by 12.

Figure 3:
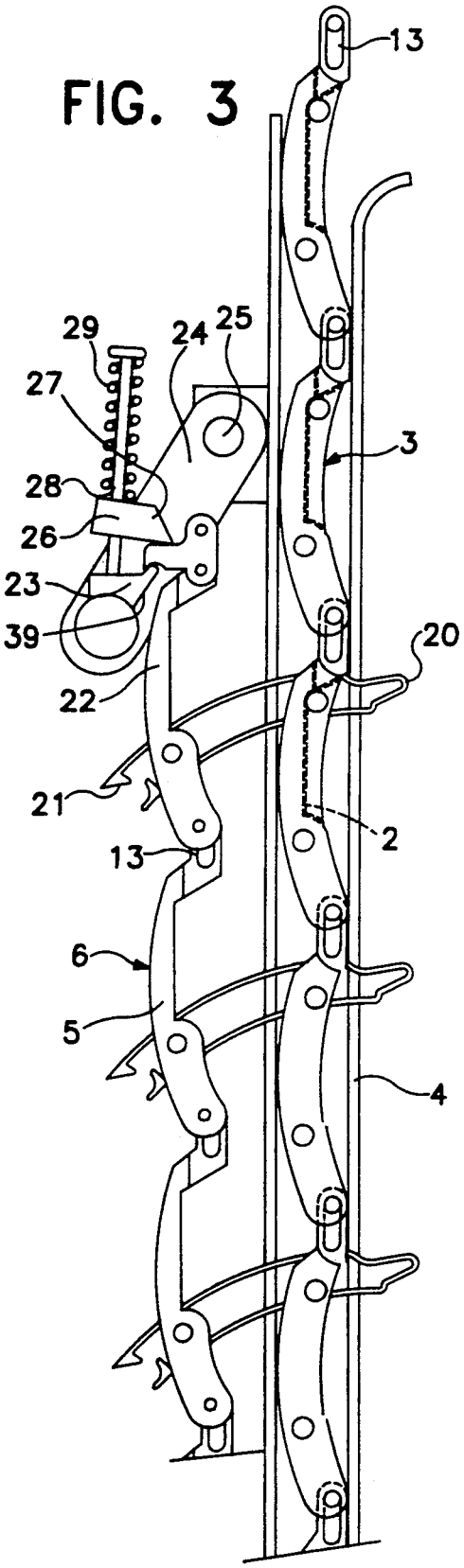
FIG. 3 is a lateral view in order to show the operative connection of pull chain links and adjusting chain links of the upper roller shutter section in the louvered position.
Figure 4:
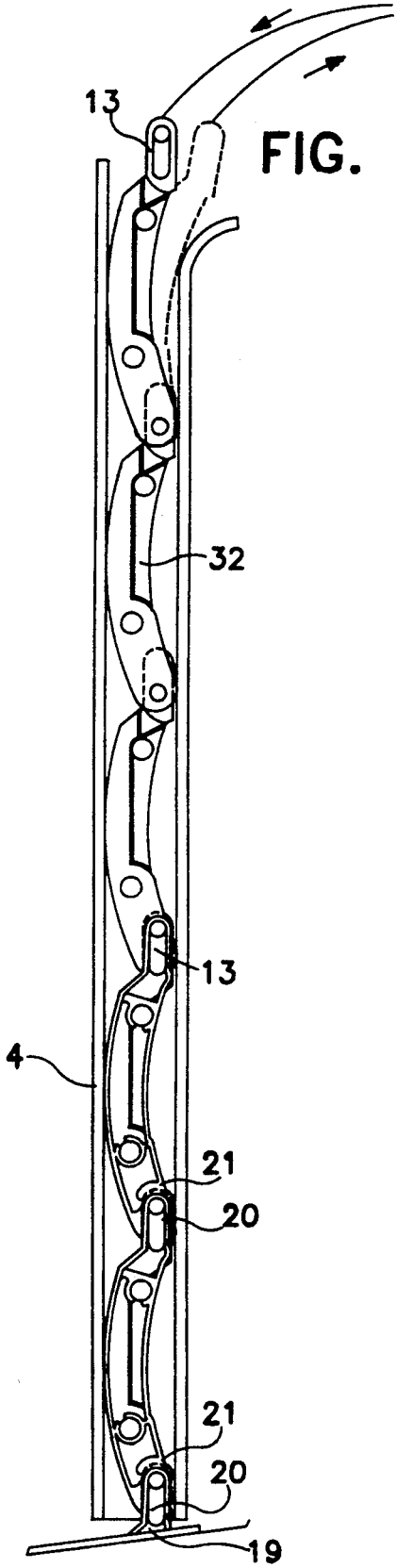
FIG. 4 is a view corresponding to FIG. 3 in the normal rolling shutter position.

In correspondence with FIGS. 1, 3 and 4, the shackles 8, 11 of the pull and adjusting chain links 2, 5 exhibit a slotted hole 13 wherein respectively the hinge pin 9 or 12 is guided in a relatively longitudinally displaceable fashion. The slotted holes 13 serve the purpose of permitting the entrance of the shutter slats 1 into a tongue-and-groove position and the release from this position, as can be seen best from FIG. 4 and as will be described also in greater detail below.

Each shutter slat 1 is articulated at its two ends to a pull and adjusting chain link 2 and 5 in order to provide a louver motion of the shutter slat 1. In accordance with FIG. 2, each shutter slat 1 is connected via a hinge pin 14 with an associated pull chain link 2 and by means of a hinge pin 15 with an associated adjusting chain link 5. Since the hinge pin 14, on account of the aligned arrangement of pull chain link, adjusting chain link, and shutter slat, must be guided past the adjusting chain link 5, the adjusting chain link 5 is equipped on its rear side with a corresponding recess 16. The hinge pin 14 is disposed in this arrangement in the upper zone of the pull chain link 2 while the hinge pin 15 is disposed in the lower zone of the adjusting chain link 5. The hinge pins 14 and 15 of one shutter slat 1 are offset with respect to each other as regards the vertical plane, namely preferably in a range from 4 to 5 mm, as characterized by the two arrows in FIG. 1 at 17. This offsetting of the two hinge points with respect to each other enhances the initiation and execution of the louver motion of the shutter slats 1. The displacement of the hinge pins 14 and 15 in the shutter slats 1 takes place in bushing-like molding sections 18 in the embodiment according to FIGS. 1–4, as can be seen from the bottom of FIG. 1. These molding sections 18 are parts of the profile either of the shutter slat 1 or of an insert molding that can be inserted or attached at the ends of the shutter slat 1. During assembly of the pull chain links, adjusting chain links, and shutter slats, these parts are thus merely plugged together laterally so that the hinge pins 14 and 15 engage, especially snap into place, in the corresponding, bushing-like molding sections 18.

The mode of operation of the louverable rolling shutter according to FIGS. 1–4 is best explained with reference to FIGS. 3 and 4, FIG. 4 showing the normal rolling shutter position wherein the opening is closed by the shutter slats, and FIG. 3 showing the louvered position wherein the shutter slats are swung out of the vertical plane into a more or less inclined oblique position so that it is possible to see through the gap in between the shutter slats.

For closing the rolling shutter, the rolling shutter is unwound in a conventional way, the pull chain links 2 being guided in the lateral U-profiles 4. The closed position is attained as soon as the lowermost shutter slat comes into abutment with the bottom, and the further slats then settle thereupon in succession; in the illustrated embodiment, a strip-like part 19 fixedly arranged on the bottom of the opening to be closed up by the rolling shutter engages with a lug-like projection 20 into a groove 21 on the lower longitudinal rim of the shutter slat 1 and/or the shutter slat is driven onto the projection 20. Since each shutter slat 1 is formed on its upper end with a lobe-shaped projection 20 and at its lower end with a recess 21 of complementary shape (see also FIG. 1), the shutter slats 1 can be moved into the tongue-and-groove position illustrated in FIG. 4 wherein the shutter slats 1 are aligned in superposition along a vertical. In this tongue-and-groove position, security against burglaries is ensured because the individual shutter slats 1 cannot be disengaged from the outside.

If the shutter slats 1 are to be brought into a louvered position, then the shutter slats 1 must be moved out of their tongue-and-groove position. In order to compensate for this movement, the slotted holes 13 are provided in the shackles 8 and 11 of the pull and adjusting chain links 2 and 5. The shutter slat can assume their louvered position only in this disengaged condition.

It should also be noted, in this connection, that in case of louverable rolling shutter slats, quite generally, the uppermost shutter slats, in most cases the uppermost three to five shutter slats, are not designed to be louverable; such louverable design is only started with the slats following therebelow. However, inasmuch as this represents a generally known situation, the present description does not address itself to this feature in detail. In any event, the adjusting chain link of the uppermost louverable shutter slat exhibits, in the illustrated embodiment, a hook 22 serving for triggering the louver motion. A counter hook 23 cooperates with this hook 22, this counter hook being located on a guide arm 24 articulated at 25 to a fixed part, for example to the U-profile 4. Above the counter hook 23, a deflection member 26 is arranged with an inclined surface 27; in the illustrated embodiment, the deflection member 26 is guided on a rod 28 and pretensioned by a spring 29 into its lower position. Upon lowering of the rolling shutter system, the hook 22 moves past the counter hook 23; the guide arm 24, upon impingement of the hook 22 on the inclined surface 27, is pivoted away toward the outside. For louvering, the rolling shutter body is to be lifted, by pulling the rolling shutter strap upwards, from a tongue-and-groove position, the hook 22 passing the counter hook 23 while coming from below, which is also enhanced herein by an inclined surface 39 bringing about a deflection of the guide arm. By pulling further in the upward direction, the hook 22 urges the deflection member 26 upwardly against the spring bias, and with further upward pulling, the hook 22 can finally pass the deflection member 26 without difficulties on account of the deflection of the guide lever 24. However, for louver purposes, the hook 22 is moved only over the counter hook 23 and then lowered again, the hook 22 then cooperating directly with the counter hook 23 since the guide arm is no longer deflected on account of an inclined surface. Upon further lowering of the rolling shutter, the hook 22 engages so that the adjusting chain links 5 are retained in their vertical position but the pull chain links 2 are lowered further so that the shutter slats 1 assume the louvered position. If the louvered position is to be eliminated, the strap is lifted again so that the pull chain links 2 are lifted, and, finally, after the shutter slats 1 have been pivoted extensively into alignment with the pull chain links 2, the hook 22 can be moved out of the engaged position, and the rolling shutter body can be pulled upwards. During this step, the associated pull and adjusting chain links and the shutter slats are again vertically aligned with one another so that the rolling shutter body can be wound up like a normal rolling shutter system. In other words, the pull chain links and the adjusting chain links are flush with the shutter slats, which is made possible by arranging the elements in alignment with one another. Accordingly, during the winding up process, the louverable rolling shutter does not become any thicker (no larger coil diameter) than a normal rolling shutter without louver device.

In the embodiment according to FIGS. 5–8, identical reference numerals have been used for the same components. In this embodiment, likewise illustrated extensively schematically only with reference to a part of the rolling shutter, the pull chain links 2 are designed to be bipartite, the halves being denoted by *2a* and *2b*. This two-piece design has advantages from a manufacturing viewpoint since the pull chain links are hollow and are made of a synthetic resin and can be assembled into the pull chain link by plugging. In this arrangement, extensively identical wall thicknesses can be attained, which is advantageous from a manufacturing viewpoint. In particular, however, on account of this bipartite design, it is possible to dispose a lamellar steel insert *2c* in between the profiled halves *2a* and *2b* whereby an increase in strength is achieved. Such an embodiment is especially suited for rolling shutters having a corresponding length and width. The off-setting of the parts at 30 is due to the fact that the pull chain links must be guided at the top and at the bottom past these parts for receiving the hinge pin 9. The illustration on the right-hand side of FIG. 5 shows the engagement of the shutter slats 1 to form the tongue-and-groove position as a consequence of the engagement of the lug-shaped projections 20 and the recesses 21. The likewise very narrow adjusting chain link 5 is bifurcate at the top at 31 in order to receive, in a hinge-like manner, the lower end of the adjusting chain link lying thereabove.

At 32, a tongue can be seen which is laterally formed at part *2b*; this tongue is also shown in FIG. 4 and covers the adjusting chain link 5 from the rear, thus preventing, in the closed position of the rolling shutter body, any see-through space between the pull chain link and the associated shutter slat 1.

The hinge pin 14 derivable from FIG. 6, for the articulated suspension of the shutter slat 1, serves simultaneously as a mounting for the two halves *2a* and *2b* of the pull chain link 2. In the embodiment according to FIG. 6, the hinge pin 14 as well as the hinge pin 15 are located in an insert molding 33 of the shutter slat 1, laterally insertable in the open end of the shutter slat 1. Thereby, the shutter slat 1 can be produced in appropriate lengths as a structural part having, in cross section, a uniform contour over the entire length, and can be cut to size to the desired shutter slat length during manufacture.

Figure 7:
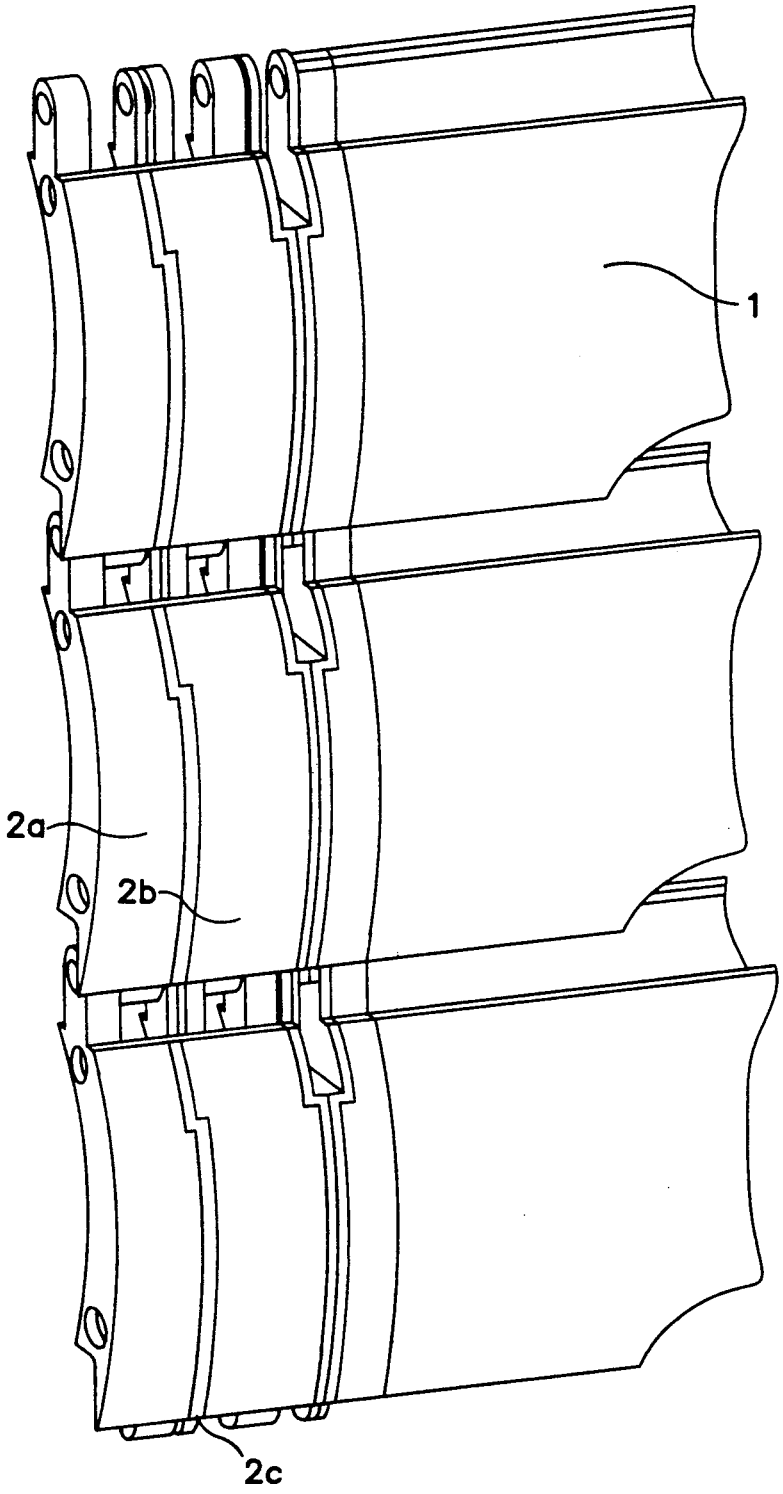
FIG. 7 is a perspective view of the rolling shutter in the normal rolling shutter position.
Figure 8:
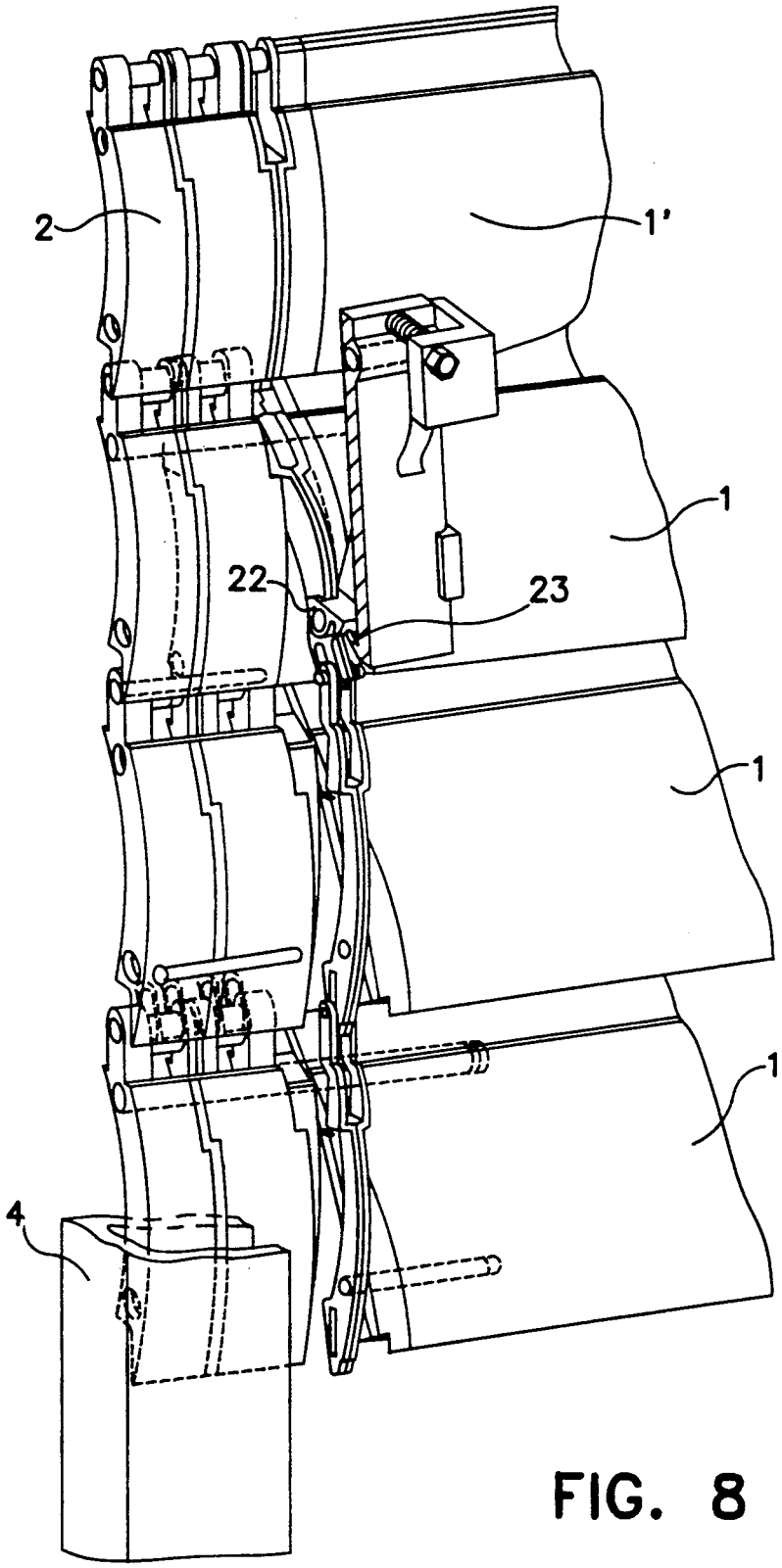
FIG. 8 shows a perspective view of a part of the rolling shutter illustrated in FIGS. 5–7 at its upper section.

FIG. 7 shows the shutter slats 1 in the normal closed position, and FIG. 8 shows the rolling shutter with louvered position of the slats 1, wherein 1' denotes the shutter slat which remains fixed, as has been described above. In FIG. 8, the fixed guide molding 4 for guiding the shutter slats 1 and/or the pull chain links 2 is schematically illustrated at the bottom.

FIG. 8 also shows a version of the hook. The hook 22 is here resiliently articulated to the adjusting chain link of the uppermost louverable shutter slat 1 so that the hook 22, during windup of the shutter slats 1, can be swung inwardly and consequently will no longer interfere during the winding up of the shutter slats 1. As soon as the hook 22 is released during unwinding of the shutter slats 1, the hook swings into the position illustrated in FIG. 8 wherein it cooperates with a fixedly located counter hook 23 for triggering the louver motion. The bottom of FIG. 8 shows hook-like terminal designs of the hinge pins 14 and 15 which engage, during joining, behind corresponding detent means at the shutter slat 1 or insert profile 33 so that the hinge pins 14 and 15 can be firmly locked into place. For assembly, the pull chain links, the adjusting chain links, and the shutter slats 1 need merely be plugged together by joining via the hinge pins. It can be seen that the shutter slats 1 are articulated to the adjusting chain links and the pull chain links completely independently and thus uncoupled from the connection of the pull chain links and adjusting chain links with one another into a chain, so that the hinge pins 14 and 15 need to be dimensioned, with respect to strength, merely for absorbing the weight of one shutter slat.

What is claimed is:

1. Louverable rolling shutter comprising: a number of louverable, leaf-like shutter slats, each slat (1) having an upper zone and a lower zone, said slats being articualted at their upper zones to pull chain links (2) and at their lower zones to adjusting chain links (5), and also being constrained laterally in fixed guide profiles (4), wherein guidance in the guide profiles (4) is effected by the pull chain links (2), each of said pull chain links (2) being arranged with an associated adjusting chain link (5) and louverable shutter slat (1) in side-by-side relationship and in alignment with respect to one another.

2. Rolling shutter according to claim 1, wherein the pull chain links are connected to one another via articualted connections (7, 8, 9) and the adjusting chain links are connected to one another via articualted connections (10, 11, 12), and the shutter slats (1) are articulated to corresponding pull chain links (2) and adjusting chain links (5) by means of separate hinge pins (14, 15) which are uncoupled from the articualted connections (7, 8, 9; 10, 11, 12) of the pull and adjusting chain links (2, 5).

3. Rolling shutter according to claim 2, wherein each louverable shutter slat (1) is articulated at its end to respectively one pull chain link (2) and one adjusting chain link (5) by means of an upper and lower hinge pin (14, 15), said hinge pins being arranged spatially between the articualted connections (7, 8, 9; 10, 11, 12) of the pull and adjusting chain links (2, 5).

4. Rolling shutter according to claim 2, wherein the hinge pins (14, 15), for suspension of the shutter slats (1), are offset with respect to each other from a vertical plane (at 17).

5. Rolling shutter according to claim 3, wherein the upper hinge pin (14) is connected to the pull chain link (2) and the lower hinge pin (15) is connected to the adjusting chain link (5) arranged between the pull chain link (2) and the shutter slat (1).

6. Rolling shutter according to claim 2, wherein the articulated connections of the pull and adjusting chain links include chain hinge members (9, 12), and the hinge pins (14, 15) are arranged offset with respect to each other from a vertical plane formed jointly by the chain hinge members (9, 12) of the pull and adjusting chain links (2, 5).

7. Rolling shutter according to claim 2, wherein the hinge pins (14, 15) are supported in insert profiles (33) adapted to be laterally inserted or locked in place in open ends of the shutter slats (1).

8. Rolling shutter according to claim 2, wherein the hinge pins (14, 15) are arranged within the cross-sectional dimensions of the shutter slats (1).

9. Rolling shutter according to claim 3, wherein the adjusting chain links (5) are provided on the rear side with a recess (16) for guiding the upper hinge pins (14) past said adjusting chain links to the shutter slat.

10. Rolling shutter according to claim 2, wherein the shutter slats (1) have upper and lower longitudinal rims, and are provided at their upper longitudinal rims with tongues (20) and on their lower longitudinal rims with complementary grooves (21) in such a way that the shutter slats (1), in the closed position, are arranged in a tongue-and-groove condition, said articualted connections of the pull and adjusting chain links including shackles (8, 11), said shackles being provided with corresponding longitudinal guide means for the accommodation and longitudinally displaceable guidance of the chain hinge member (9, 12).

11. Rolling shutter according to claim 1, wherein the pull chain links (2) are bipartite (**2*a*, 2*b*) and have a reinforcing insert (2*c***) therebetween.

12. Rolling shutter according to claim 1, wherein a hook (22) is arranged on the uppermost louverable shutter slat (1), said hook cooperating with a counter hook (23) for triggering a louver motion.

13. Rolling shutter according to claim 12, wherein the counter hook (23) is arranged on a pivotably supported guide lever (24).

14. Rolling shutter according to claim 13, wherein the counter hook (23) has deflecting means (26, 27, 39) for the guide lever (24).

15. Rolling shutter according to claim 12, wherein the hook (22) is supported on the adjusting chain link (5) to be pivotable inwards against a spring action in such a way that the hook, upon unwinding of the rolling shutter, is brought forward into an operative position, and upon winding up, can be moved into an inwardly swung position.

* * * * *